US010529508B2

(12) United States Patent
Wu

(10) Patent No.: US 10,529,508 B2
(45) Date of Patent: Jan. 7, 2020

(54) SIGNAL FEEDBACK APPARATUS

(71) Applicant: DINKLE ENTERPRISE CO., LTD., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/143,462

(22) Filed: Sep. 27, 2018

(65) Prior Publication Data

US 2019/0035575 A1 Jan. 31, 2019

Related U.S. Application Data

(63) Continuation of application No. 15/634,544, filed on Jun. 27, 2017, now Pat. No. 10,121,615.

(51) Int. Cl.
*H01H 15/10* (2006.01)
*H01H 71/02* (2006.01)
(Continued)

(52) U.S. Cl.
CPC ..... *H01H 15/10* (2013.01); *H01H 71/02* (2013.01); *H01H 71/0207* (2013.01);
(Continued)

(58) Field of Classification Search
CPC .... H01H 15/10; H01H 71/0207; H01H 71/02; H01H 2071/088; H01H 71/0228; H01H 2071/008; H01H 2235/01
(Continued)

(56) References Cited

U.S. PATENT DOCUMENTS 4,380,693 A * 4/1983 Kuhlmann ..... H01H 9/06 200/321
4,431,884 A * 2/1984 Flumignan ..... H01H 21/40 200/241
(Continued)

FOREIGN PATENT DOCUMENTS

CN 201466705 U 5/2010
CN 104810814 A 7/2015
(Continued)

OTHER PUBLICATIONS

Office Action dated Apr. 17, 2019 of the corresponding China patent application of US parent patent.

*Primary Examiner* — Edwin A. Leon
*Assistant Examiner* — Lheiren Mae A Caroc
(74) *Attorney, Agent, or Firm* — Chun-Ming Shih; HDLS IPR Services

(57) ABSTRACT

A liquid-cooled heat dissipation apparatus includes a base (10), a telesignaling linkage member (20), a sliding plate (30) and a switch module (40). The telesignaling linkage member (20) is moveably installed on the base (10). The sliding plate (30) is installed corresponding to the telesignaling linkage member (20) and generates a movement along with the telesignaling linkage member (20). The switch module (40) includes a microswitch (41) arranged corresponding to the sliding plate (30) such that the microswitch (41) is operably opened or closed based on the movement of the sliding plate (30). Accordingly, through the opening and closing of the microswitch, the telesignaling monitoring on the functional module state can be achieved.

12 Claims, 6 Drawing Sheets

(51) Int. Cl.
*H01H 71/00* (2006.01)
*H01H 71/08* (2006.01)

(52) U.S. Cl.
CPC ... *H01H 71/0228* (2013.01); *H01H 2071/008* (2013.01); *H01H 2071/088* (2013.01); *H01H 2235/01* (2013.01)

(58) Field of Classification Search
USPC ..... 200/329–331, 337
See application file for complete search history.

(56) References Cited

U.S. PATENT DOCUMENTS 4,973,807 A * 11/1990 Stabler ..... H01H 9/06
200/321
10,121,615 B1 * 11/2018 Wu ..... H01H 15/10

FOREIGN PATENT DOCUMENTS

| | | | |
|---|---|---|---|
| CN | 105790244 | A | 7/2016 |
| CN | 205595786 | U | 9/2016 |
| CN | 206023205 | U | 3/2017 |
| CN | 206819951 | U | 12/2017 |
| WO | 2012152111 | A1 | 11/2012 |

* cited by examiner

SIGNAL FEEDBACK APPARATUS

CROSS-REFERENCE TO RELATED APPLICATION

This application is a continuing application of U.S. patent application Ser. No. 15/634,544, filed on Jun. 27, 2017, and entitled "SIGNAL FEEDBACK APPARATUS". The entire disclosures of the above application are all incorporated herein by reference.

BACKGROUND OF THE INVENTION

Field of the Invention

The present invention is related to a signal feedback apparatus, in particular, to signal feedback apparatus used in a surge protection device (SPD).

Description of Related Art

Electronic components of surge protection devices, terminal blocks and relay etc. are commonly used in electric circuits in households, office places and factory sites, and they are mainly used for preventing damages of electrical equipment caused by transient overvoltage. When peak current or voltage is generated on the electric loop or telecommunication circuit due to external interferences, a surge protection device is able to guide and shunt the current within an extremely short period of time in order to prevent surge from damaging other equipment in the loop.

In a common surge protection device, it typically comprises an element of Metal Oxide Varistor (MOV) (i.e., a voltage dependent resistor). After a long period of use, the voltage dependent resistor tends to age and generates heat. To prevent accidents such as fire caused by increase of temperature, the surge protection device typically includes a trip mechanism. The trip mechanism is in series connection with the voltage dependent resistor such that when the temperature increases, the voltage dependent resistor is disengaged from the circuit.

For a currently existing SPD telesignaling device, it typically includes a microswitch installed therein for each level. In addition, these microswitches are connected to the telesignaling terminal block via corresponding circuits such that the mechanism moves through actions on each microswitch. Each level performs action independently, and the device is of complicated structure while requiring greater number of components; consequently, its manufacturing process is complicated in practice.

In view of the above drawbacks of the currently existing technologies, the inventor seeks to provide a reasonable design capable of effectively improving the aforementioned drawbacks after years of researches along with utilization of academic theories and principles.

SUMMARY OF THE INVENTION

The present invention provides a signal feedback apparatus capable of utilizing the opening and closing of a microswitch to achieve the telesignaling monitoring on the states of the functional modules.

To achieve the aforementioned objectives, the present invention provides a signal feedback apparatus, comprising a base, a telesignaling linkage member, sliding plate and switch module. The telesignaling linkage member is moveably installed on the base. The sliding plate is installed corresponding to the telesignaling linkage member and is configured to generate a movement along with the telesignaling linkage member. The switch module comprises a microswitch. The microswitch is arranged corresponding to the sliding plate and is configured to operably open or close the microswitch based on the movement of the sliding plate.

Preferably, the telesignaling linkage member comprises a linkage shaft, the linkage shaft includes a driving oblique surface, and the sliding plate includes a driven oblique surface such that when the functional rotating member presses onto the protruding column, the driven oblique surface of the sliding plate is blocked by the driving oblique surface of the linkage shaft. When the functional rotating member rotates to allow the protruding column of the linkage member to be released, the driving oblique surface pushes the driven oblique surface such that the sliding plate moves along the sliding slot to press onto the microswitch. The arrangement of the driven oblique surface and driving oblique surface allow the telesignaling linkage member sliding member to slide more stably.

Preferably, a resultant force of all of the sliding plate springs is smaller than the elastic force of one single linkage shaft spring. Accordingly, it is able to ensure that after the tripping of the SPD at any level, the signal feedback apparatus is able to send out signal in order to ensure that each tripping is effectively fed back to the control end; therefore, the safety and reliability of SPD are increased while the number of components required is reduced.

Preferably, the signal feedback apparatus includes a top cover, and the top cover is of a U-shape plugging socket. The inner wall of the U-shape plugging socket includes a locking slot, the electrical unit includes an outer casing, and the outer casing includes a latch such that when the electrical unit is inserted onto the base, the latch is locked onto the locking slot at the inner wall of the U-shape socket. Therefore, the connection between the signal feedback apparatus and the electrical unit is convenient and fast, which is also able to prevent the electrical unit from loose connection or disengagement; consequently, the product safety is increased.

Preferably, the base includes an electrical connector, and the electrical connector includes a metal clamp and a lead wire. The metal clamp and the lead wire are soldered onto each other. The metal clamp is clamped onto the first electrical connection pin and the second electrical connection pin of the tripping mechanism in order to form a conductive circuit.

Preferably, the base includes a limiting point, and the linkage shaft includes a protrusion such that when the linkage shaft is installed inside the base, the protrusion is locked onto the limiting portion in order to prevent the linkage shaft from being ejected by the spring after the installation thereof.

The signal feedback apparatus of the present invention uses one microswitch only, and it is able to utilize one sliding plate for linking surge protection modules of multiple levels together. Each level is provided with a telesignaling linkage shaft linked to the sliding plate and the surge protection module such that when the surge protection module of any one level is of malfunctioned tripping, the telesignaling device is able to send out signals. The present invention utilizes the mechanical connection structure of independent linkage for each level such that the mechanical connection is table, the component quantity required is small, the manufacturing process in practice is facilitated and the cost is relatively lower. In addition, the present invention is able to ensure that each tripping can be effectively fed back to the control end in order to increase the safety and reliability of an SPD.

DETAILED DESCRIPTION OF THE INVENTION

Figure 1:
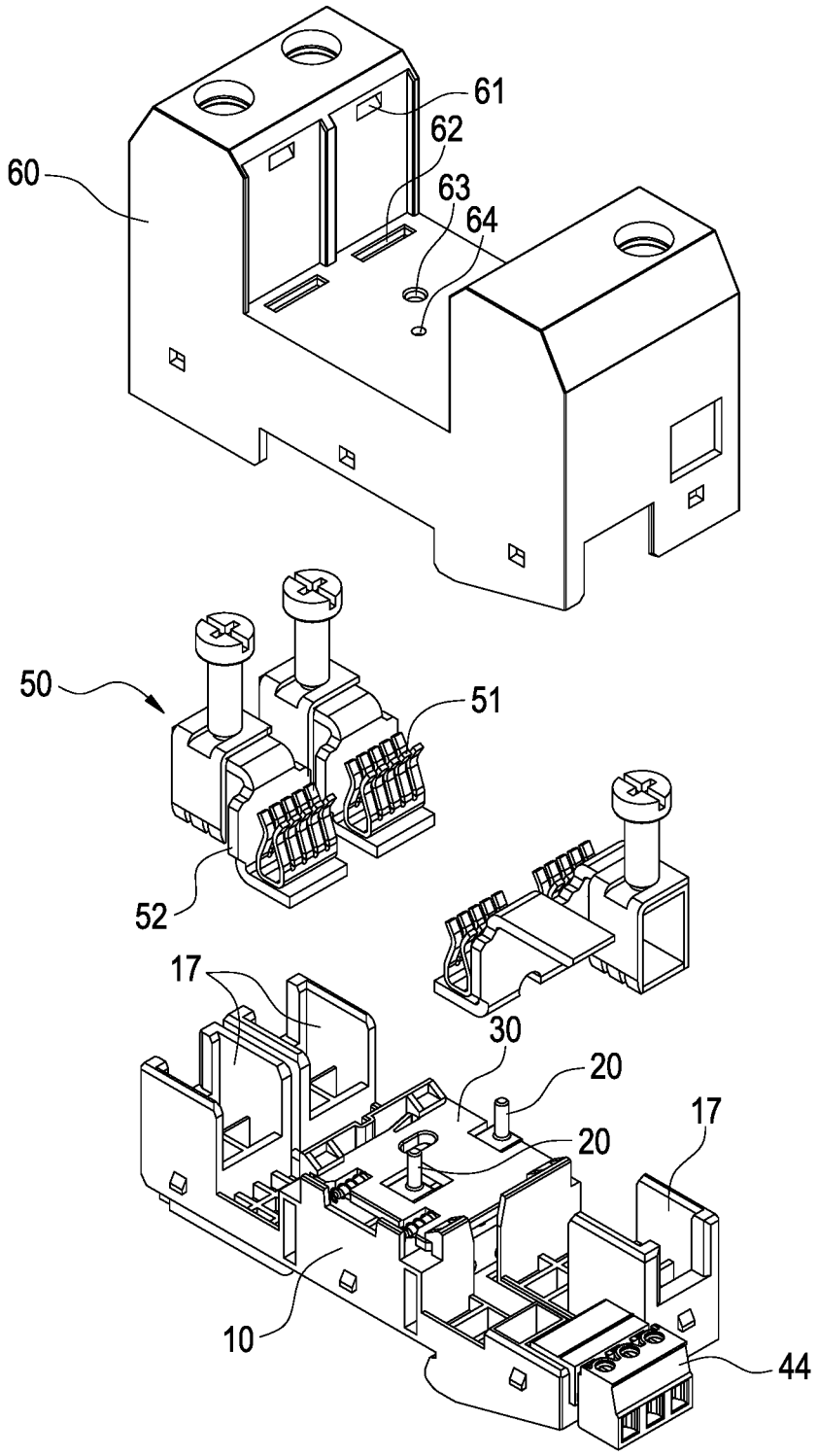
FIG. 1 is an exploded view of the signal feedback apparatus of the present invention.
Figure 2:
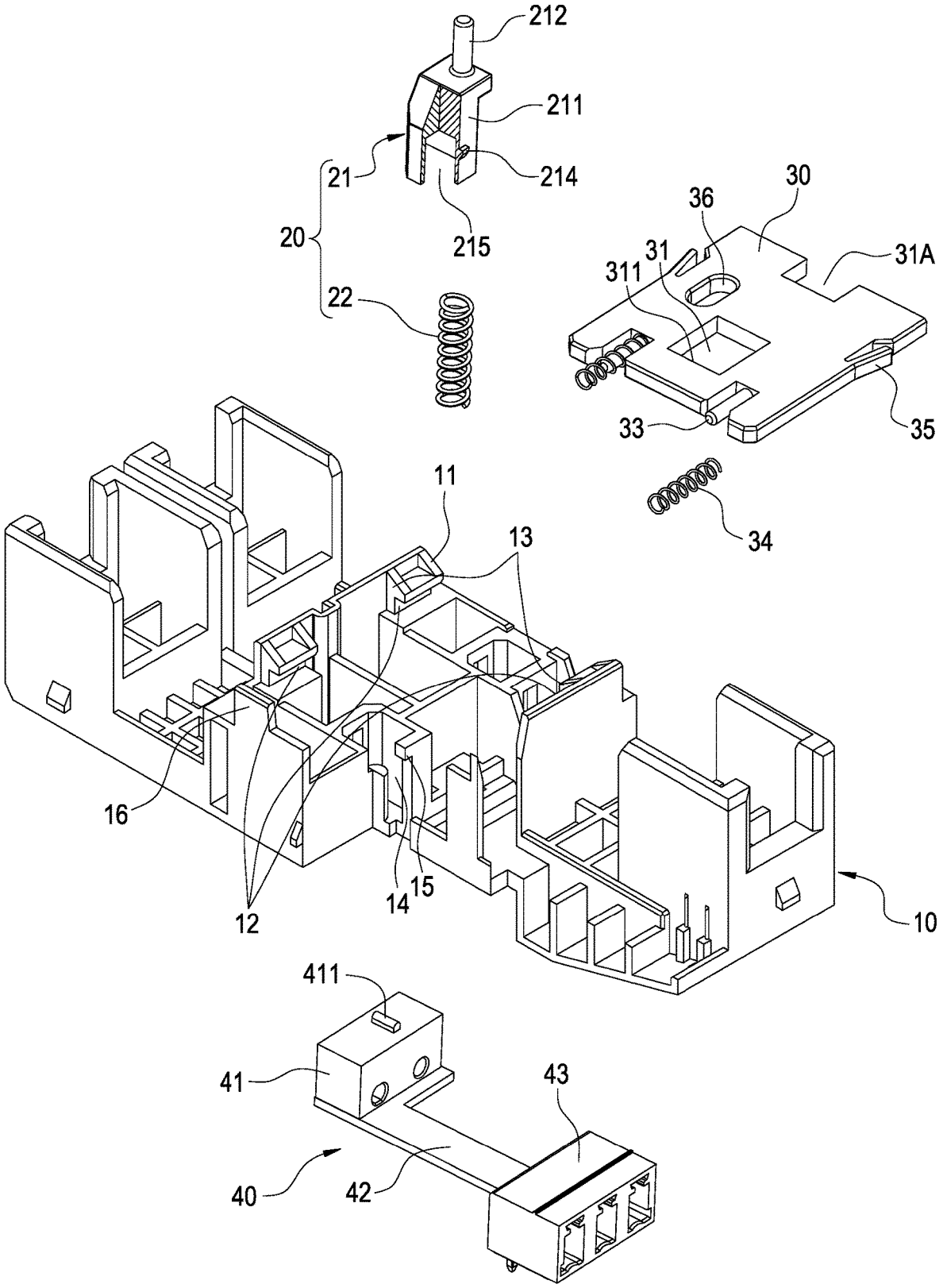
FIG. 2 is an exploded view of the base, telesignaling linkage member, sliding plate and switch module of the present invention.
Figure 3:
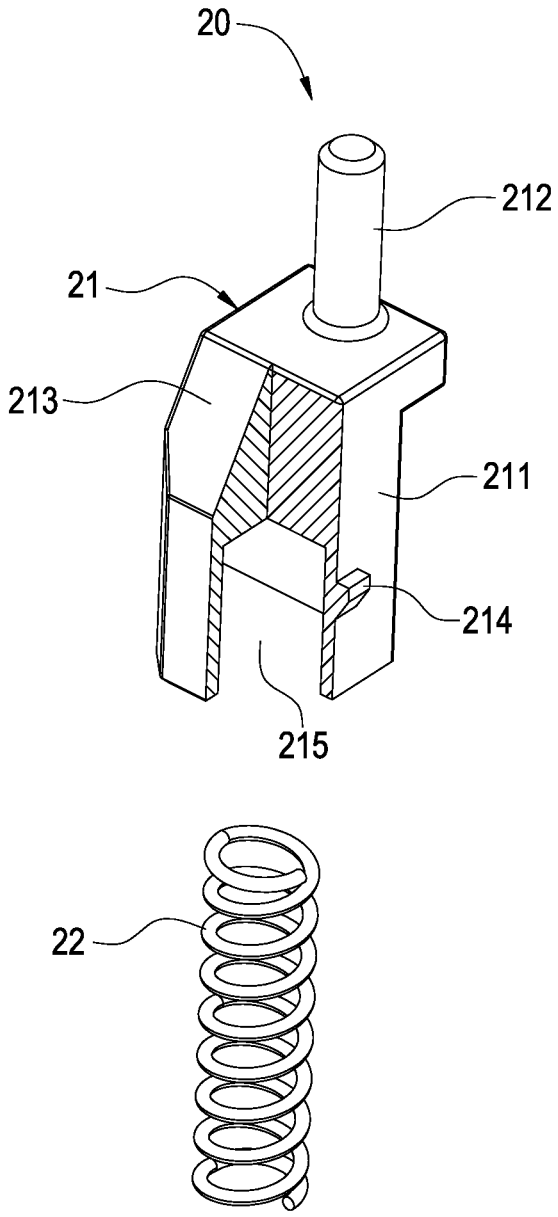
FIG. 3 is a perspective exploded view of the telesignaling linkage member of the present invention.
Figure 4:
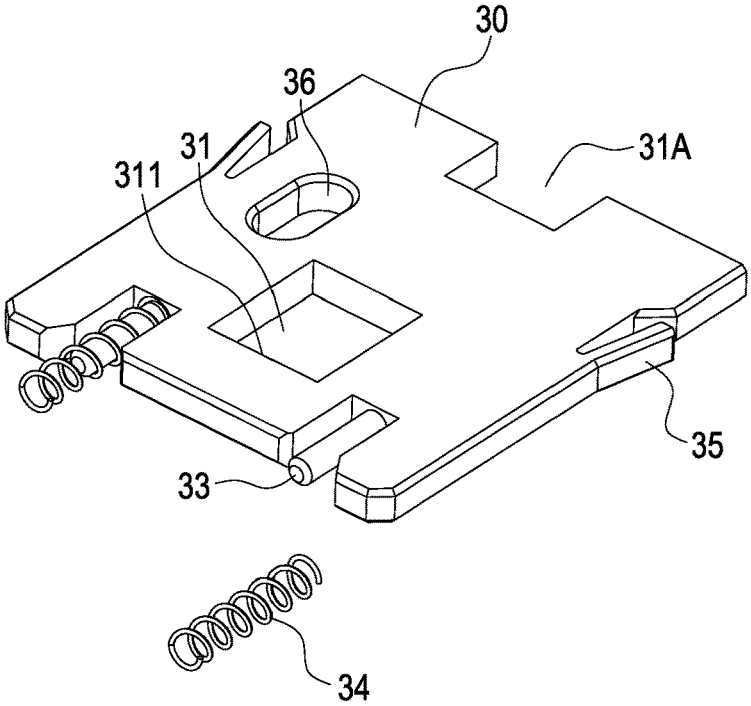
FIG. 4 is a perspective view of the sliding plate of the present invention.
Figure 5:
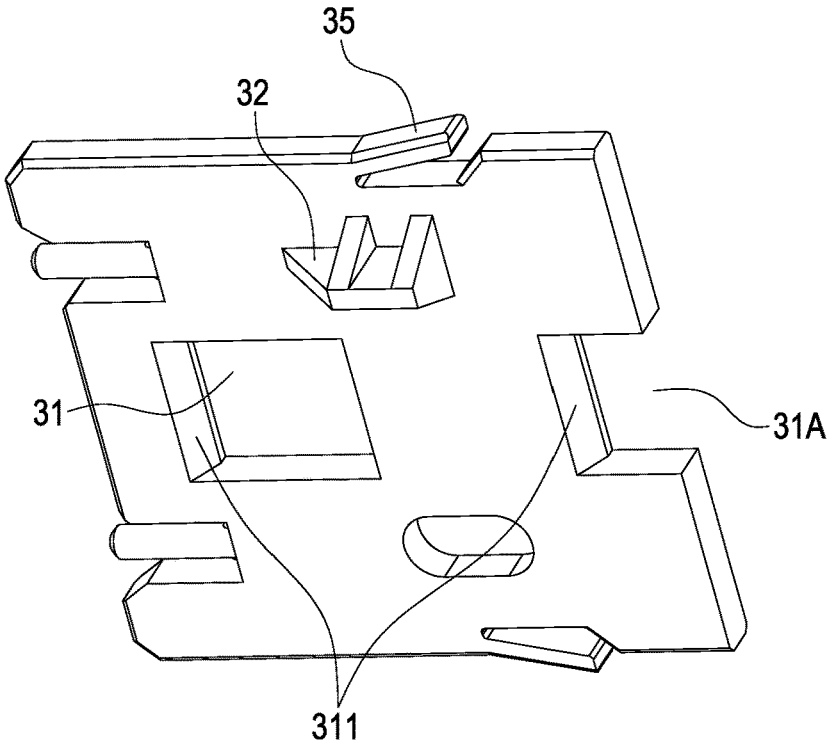
FIG. 5 is another perspective view of the sliding plate of the present invention viewed from another angle.

The following provide a detailed description on the preferred embodiments of a signal feedback apparatus of the present invention along with the accompanied drawings.

As shown in FIG. 1~5, the present invention provides a signal feedback apparatus, which can be a socket base, comprising a base 10, a telesignaling linkage member 20, a sliding plate 30 and a switch module 40.

The base 10 is generally of an elongated shape and includes a plurality of hooks 11 formed at a middle region thereof. Each hook 11 is arranged spaced apart from each other, and a sliding slot 12 is formed at a lower edge among each hook 11. One side of the hook 11 is formed of an end surface 13. The middle region of the base 10 includes an installation hole 14 formed thereon. In this embodiment, the quantity of the installation hole 14 is two. One side of each one of the installation holes 14 includes a groove formed thereon, and a top edge of the groove is formed of a limiting point 15. The base 10 at the rear end of the sliding slot 12 is formed of a blocking wall 16. The two side regions of the base 10 include a plurality of receiving slots 17 formed thereon respectively.

The telesignaling linkage member 20 is received inside the installation hole 14. In this embodiment, the quantity of the telesignaling linkage member 20 is two, and each telesignaling linkage member 20 comprises a linkage shaft 21 and a linkage shaft spring 22. The linkage shaft 21 includes a cylindrical member 211 and a protruding column 212 extended upward from the top end of the cylindrical member 211, such that the cylindrical member 211 and the protruding column 212 are integrally connected along a longitudinal direction of the cylindrical member 211 and the protruding column 212. One side of the cylindrical member 21 is formed of a driving oblique surface 213 and another side thereof is formed of a protrusion 214. In addition, the internal of the cylindrical member 211 is formed of an inner hole 215. The linkage shaft spring 22 is longitudinally received inside the inner hole 215 and the installation hole 14. The protrusion 214 is received inside the aforementioned groove. The limiting point 15 is used for blocking the protrusion 214 in order to ensure that the linkage shaft 21 is not ejected by the linkage shaft spring 22 after the installation thereof.

The sliding plate 30 is generally a rectangular plate. The middle region of the sliding plate 30 and the front side thereof include a rectangular hole 31 and a notch 31A formed thereon respectively. The rectangular hole 31 and the notch 31A include a side wall formed of a driven oblique surface 311 respectively. The bottom surface of the sliding plate 30 includes a microswitch triggering piece 32 protruded therefrom. Two sides of the rear of the sliding plate 30 include a securement column 33 formed thereon respectively and provided for a sliding plate spring 34 to be mounted thereon; wherein a resultant force of the two sliding plate springs 34 is smaller than the elastic force of one single linkage shaft spring 22. The two left and right sides of the sliding plate 30 include a positioning retainer 35 formed thereon respectively. The sliding plate 30 is moveably received inside the sliding slot 12 and uses the positioning retainer 35 to abut against the end surface 13. One end of the sliding plate spring 34 abuts against the blocking wall 16 in order to allow the blocking wall 16 to provide a continuous push force to the sliding plate 14. Furthermore, one side the rectangular hole 31 is formed of an anti-misfit hole 36.

The switch module 40 *s* installed at a corner of the base 10. The switch module 40 comprises a microswitch 41, a circuit board 42, a terminal block 43 and a telesignaling connection terminal 44. The microswitch 41 includes a microswitch button 411. The microswitch 41 and the terminal block 43 are soldered onto the circuit board 42, and the microswitch 41 is arranged corresponding to the aforementioned microswitch triggering piece 32 such that the microswitch 41 can be operably opened or closed based on the movement of the sliding block 30.

The signal feedback apparatus of the present invention further comprises a plurality of electrical connectors 50. Each electrical connector 50 is installed inside each receiving slot 17 of the base 10. Each electrical connector 50 comprises a lead wire 51 and a metal clamp 52 electrically connected to the lead wire 51.

The signal feedback apparatus of the present invention further comprises a top cover 60 for covering onto the base 10 correspondingly. The top cover 60 includes a U-shape socket opening, and a locking slot 61 is formed at corresponding location of the two side plates respectively. In addition, the bottom plate is formed of an insertion slot 62 corresponding to the aforementioned metal clamp 52; furthermore, a through hole 63 is formed at a location corresponding to the aforementioned anti-misfit insertion hole 36; moreover, a perforation 64 is formed at a location corresponding to the aforementioned protruding column 212 in order to allow the protruding column 212 to penetrate therethrough.

Figure 6:
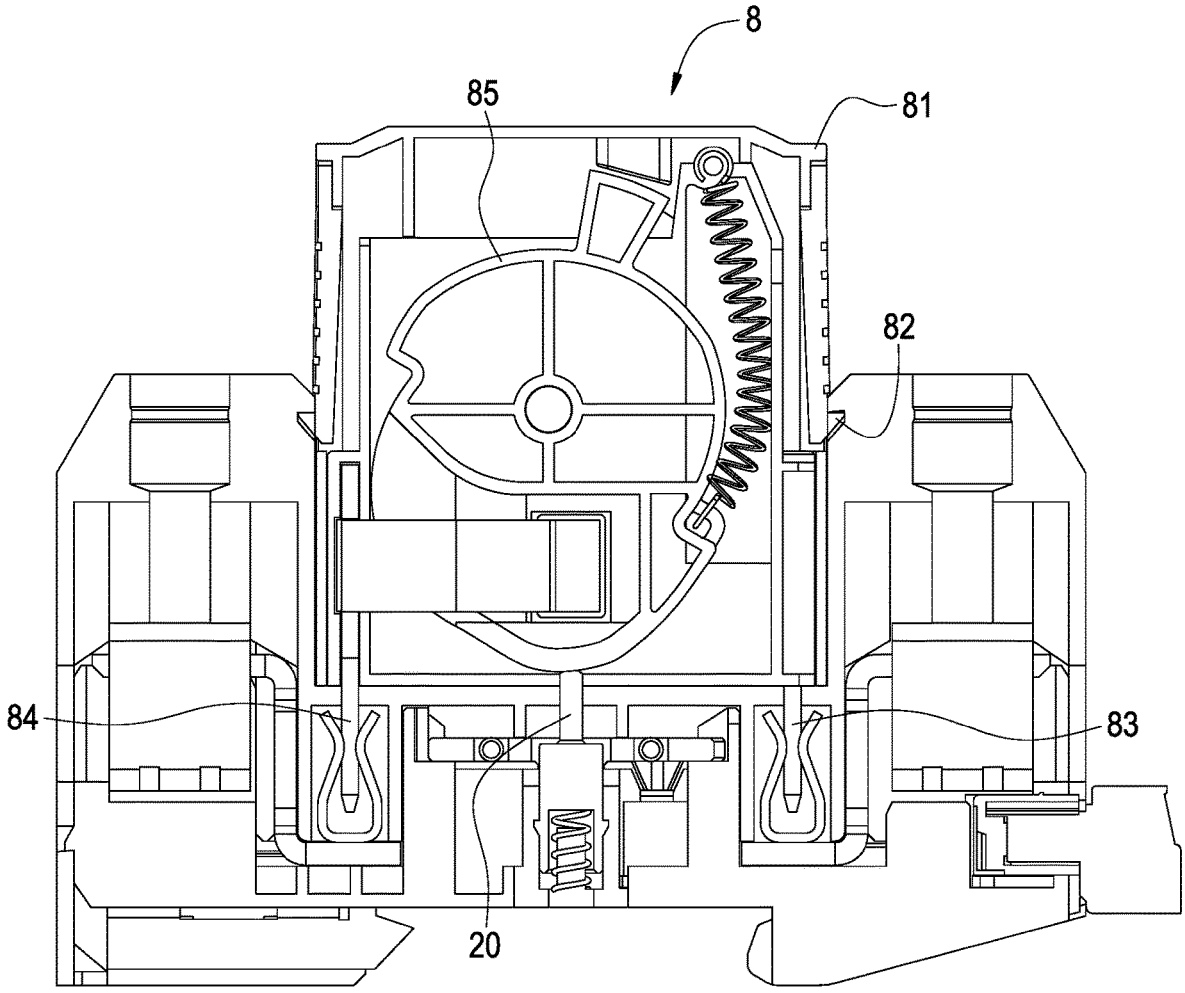
FIG. 6 is an assembly view of the present invention applied to an electrical unit.

As shown in FIG. 6, the signal feedback apparatus of the present invention can be provided for uses of an electronic unit 8, such as an SPD, a terminal block or a relay etc. In this embodiment, a two-level SPD is used for illustration, and it comprises an outer casing 81, and a latch 82 formed at side walls of the outer casing 81 respectively. The internal of the outer casing 81 can be installed with a voltage dependent resistor (not shown in the figures), and the bottom end of the outer casing 81 includes a first electrical connection pin 83 and a second electrical connection pin 84 extended therefrom. Furthermore, the central region of the electrical unit 8 includes a functional rotating member 85. During the use, the electrical unit 8 is placed into the opening slot of the top cover 60, and each latch 82 is locked onto the corresponding locking slot 61 respectively. In addition, the first electrical connection pin 83 and the second electrical connection pin 84 are inserted into the insertion slot 62 in order to be clamped by the metal clamp 52 of each electrical connector 50 and to form a conductive circuit. Moreover, the functional rotating member 85 performs the downward press action corresponding to the protruding column 212 of the linkage shaft 21.

Figure 7:
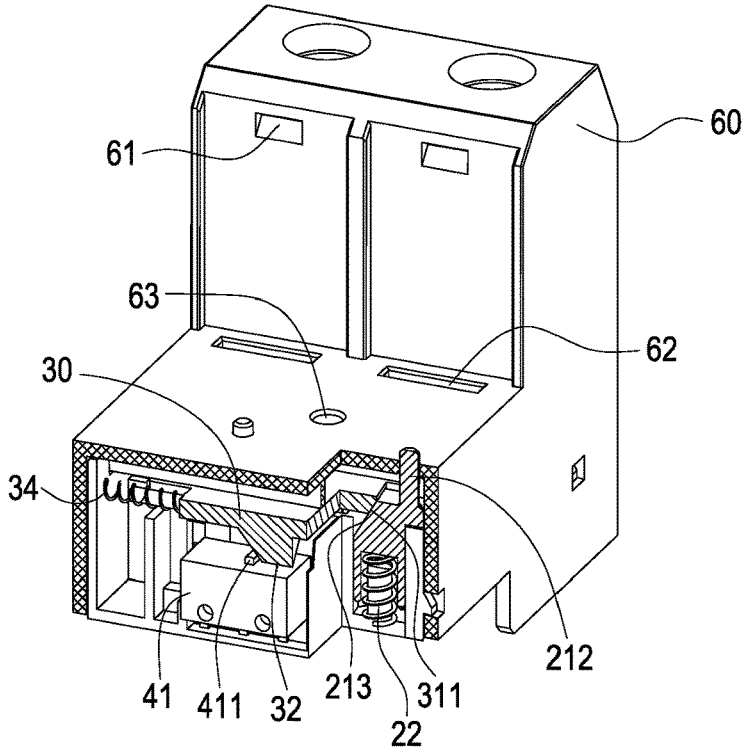
FIG. 7 is a state of use view (1) of the signal feedback apparatus of the present invention.

FIG. 7 shows a normal working state of the voltage dependent resistor. At this time, when the functional rotating member 85 presses downward on to the protruding column 212 of the linkage shaft 21 (as shown in FIG. 6), the linkage shaft spring 22 is under the maximum compression state. Under the pushing force of the sliding plate spring 34 exerted onto the sliding plate 30, the driven oblique surface 311 of the sliding plate 30 is blocked at the right end of the sliding slot 12 by the driven oblique surface 213 of the linkage shaft 21. During the same time, the microswitch triggering piece 32 on the sliding plate 30 has no effect on the microswitch button 411, and the microswitch button 411 is under a naturally extended state elastically, indicating the voltage dependent resistor is under a normal working state.

Figure 8:
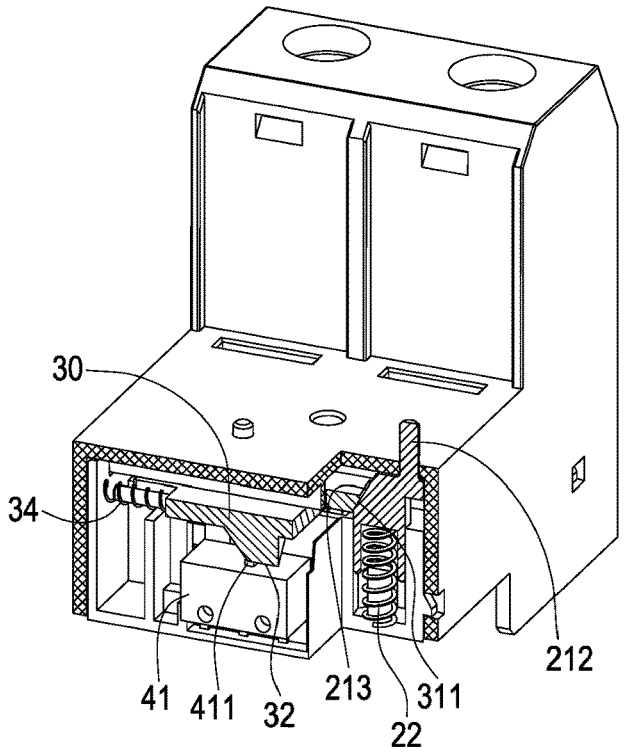
FIG. 8 is a state of use view (2) of the signal feedback apparatus of the present invention.

FIG. 8 shows a tripped state of the voltage dependent resistor. The functional rotating member 85 rotates counterclockwise such that the protruding column 212 of the linkage shaft 21 is released, and the functional rotating shaft 85 generates a release effect on the linkage shaft 21. The protruding column 212 of the linkage shaft 21 is provided with an upward movement space, and the linkage shaft 21 bounces upward under the push effect of the linkage shaft spring 22, indicating that the voltage dependent resistor is under a tripped state, i.e. a malfunction state. Under the effect of the elastic force, the driving oblique surface 213 drives the sliding plate 30 to move leftward along the sliding slot 12 via the driven oblique surface 311. When the linkage shaft 21 is completely extended elastically, the sliding plate 30 is of a stroke with the maximum movement and the sliding plate spring 34 is compressed such that the microswitch triggering piece 32 presses downward on the microswitch button 411. Since the resultant force of the two sliding plate spring 34 is smaller than the elastic force of one single linkage shaft spring 22, the use of only one microswitch 41 and one sliding plate 30 is sufficient to allow the signal feedback apparatus of the present invention to send out a failure warning signal to the control system after the SPD of any level is tripped in order to ensure that every trip is effectively fed back to the control end. Therefore, it is able to alert the maintenance personnel to readily replace the failed SPD such that the safety and reliability of SPD is increased while the apparatus is of small quantity of components, reduced size, facilitated for manufacturing in practice and relatively lower cost.

In view of the above, the signal feedback apparatus of the present invention is able to achieve the expected purpose of use and to overcome the drawbacks of prior arts. The present invention is of novelty and inventive step to comply with the patentability of invention patents. The scope of the present invention shall be determined based on the claims defined hereafter, and the scope of the present invention shall cover all equivalent modifications such that it shall not be limited to the descriptions provided above.

What is claimed is:

1. A signal feedback apparatus, comprising:

a base (10);

a telesignaling linkage member (20) moveably installed on the base (10);

a sliding plate (30) installed corresponding to the telesignaling linkage member (20) and configured to generate a movement along with the telesignaling linkage member (20); and a switch module (40) comprising a microswitch (41); the microswitch (41) arranged corresponding to the sliding plate (30) and configured to operably open or close the microswitch (41) based on the movement of the sliding plate (30), wherein the base (10) includes an installation hole (14), the telesignaling linkage member (20) comprises a linkage shaft (21), and the linkage shaft (21) includes a cylindrical member (211) and a protruding column (212) longitudinally extended from the top of the cylindrical member (211); the cylindrical member (211) is received inside the installation hole (14); and wherein the telesignaling linkage member (20) further comprises a linkage shaft spring (22), an inner hole (215) is formed in the cylindrical member (211); the linkage shaft spring (22) is fully longitudinally received inside the inner hole (215) and the installation hole (14).

2. The signal feedback apparatus according to claim 1, wherein the base (10) includes a limiting point (15), the telesignaling linkage member (20) comprises a linkage shaft (21), and the linkage shaft (21) includes a protrusion (214) such that when the linkage shaft (21) is placed inside the base (10), the protrusion (214) locks onto the limiting point (15).

3. The signal feedback apparatus according to claim 1, wherein the sliding plate (30) includes two securement columns (33) formed thereon respectively, and each one of the securement columns is provided for a sliding plate spring (34) to be mounted thereon; a resultant force of the sliding plate spring (34) is smaller than an elastic force of one single unit of the linkage shaft spring (22).

4. The signal feedback apparatus according to claim 3, wherein the base (10) is formed of a blocking wall (16), and one end of each one of the sliding plate spring (34) abuts against the blocking wall (16).

5. The signal feedback apparatus according to claim 1, wherein the cylindrical member (211) includes a driving oblique surface (213) formed at one side thereon, the sliding plate (30) includes a driven oblique surface (311), and the driving oblique surface (213) engages with the driven oblique surface (311).

6. The signal feedback apparatus according to claim 1, wherein the sliding plate (30) includes a rectangular hole (31) and a notch (31A) formed thereon, telesignaling member (20) comprises two linkage shafts (21), and the two linkage shafts (21) penetrate through the rectangular hole (31) and the notch (31A) respectively.

7. The signal feedback apparatus according to claim 6, wherein two driven oblique surfaces (311) are formed on the rectangular hole (31) and the notch (31A) respectively, the linkage shafts (21) include a driving oblique surface (213) formed thereon respectively, and each one of the driving oblique surfaces (213) engages with each one of the corresponding driven oblique surfaces (311).

8. The signal feedback apparatus according to claim 6, wherein the sliding plate (30) includes an anti-misfit hole (36) formed thereon, and the anti-misfit hole (36) is disposed at one side of the rectangular hole (31).

9. The signal feedback apparatus according to claim 1, wherein the microswitch (41) includes a microswitch button (411) and the sliding plate (30) includes a microswitch triggering piece (32) such that the microswitch triggering piece (32) is used to press or release the microswitch button (411).

10. The signal feedback apparatus according to claim 1, further comprising an electrical connector (50); the base (10) includes a receiving slot (17) formed thereon; the electrical connector (50) is inserted into the corresponding receiving slot (17) for attachment therewith.

11. The signal feedback apparatus according to claim 10, wherein the electrical connector (50) includes a lead wire (51) and a metal clamp (52); the metal clamp (52) is soldered onto the lead wire (51).

12. The signal feedback apparatus according to claim 1, further comprising a top cover (60); the top cover (60) includes a U-shape socket opening, and the inner side wall of the U-shape socket opening includes a locking slot (61).

* * * * *